United States Patent [19]

Lamb

[11] Patent Number: 4,801,148

[45] Date of Patent: Jan. 31, 1989

[54] MILITARY BOARDGAME

[76] Inventor: Donald J. Lamb, Rural Route 3, Box 2410, McMillan, Mich. 49853

[21] Appl. No.: 121,227

[22] Filed: Nov. 16, 1987

[51] Int. Cl.[4] ..... A63F 3/00

[52] U.S. Cl. ..... 273/255; 273/265; 273/284

[58] Field of Search ..... 273/265, 255, 262, 287, 273/284

[56] References Cited

U.S. PATENT DOCUMENTS

| | | | |
|---|---|---|---|
| 2,794,641 | 6/1957 | Boker et al. | 273/265 |
| 3,101,947 | 8/1963 | Dzuris | 273/284 |
| 3,149,842 | 9/1964 | Cirrincione | 273/265 |

FOREIGN PATENT DOCUMENTS

| | | | |
|---|---|---|---|
| 718991 | 11/1931 | France | 273/265 |

*Primary Examiner*—Richard C. Pinkham
*Assistant Examiner*—Benjamin Layno

[57] ABSTRACT

A board game apparatus for playing is provided. The apparatus includes a set of game boards, each having a matrix of holes arranged in mutually orthogonal rows and columns for receiving game pieces that are coded according to the adversary and the type and size of military unit they represent and that are deployed according to the discretion of each player. A variety of actual topographical map sets, representing scenes of battle, may be secured under transparent overlays bearing lines of latitude and longitude, each point of intersection of which corresponds to a hole in a game board. Dice, spinning devices and cards are also provided to define such game variables as unit movement, limiting weather conditions, missions, support, special situations and battle objectives.

24 Claims, 5 Drawing Sheets

MILITARY BOARDGAME

TECHNICAL BACKGROUND

This invention relates generally to strategic and tactical board games and more specifically to those employing playing pieces that represent adversarial units having specified capabilities, that are deployed with respect to a defined geographic arena of operation, and that are controlled in part by random instructions indicated by dice, cards, spinning devices and the like.

BACKGROUND ART

A number of games have been designed that attempt to simulate certain realistic but hypothetical situations. Common among these are ones that simulate land, air and particularly naval battles. Many of these games employ stationary game pieces; and many others offer players no active control over the movement of game pieces after their initial deployment, the subsequent progress of the game being dictated by mere chance. Most of the games are designed to provide pure entertainment, and few proffer an opportunity for players to develop even limited strategic or tactical skills, much less an opportunity to learn anything about history or geography. See, for example, U.S. Pat. Nos. 2,293,298; 2,794,641; 3,191,937; 3,404,889, 3,779,553; 3,809,408; 4,003,578; 4,004,810; 4,016,939; 4,057,253; 4,078,805; 4,093,236; 4,120,503; 4,185,832; 4,280,704; and 4,572,514.

DISCLOSURE OF THE INVENTION

In accordance with the present invention, a military warfare board game is provided that offers, in addition to an entertaining diversion, an opportunity to learn strategy, tactics, geography and history.

The preferred embodiment of the present invention contemplates a board game having a number of maps representing actual locations of widely different terrains and climates to provide a variety of simulated battle areas, such an embodiment also providing for the optional use of maps obtained by, and representing locations of special interest to, individual players. The provision for the use of maps representing actual places enables players, by simulation, to recreate or modify historic battles and thereby has the additional capability both of promoting an interest in and of teaching a meaningful amount of history and geography. Topographical relief maps may also be used to add another dimension to maneuvers.

The preferred embodiment of the present invention also contemplates a board game that is dynamic in that it affords players substantial opportunity to place and move game pieces according to their own strategies and tactics, thereby simultaneously stimulating an interest in and assisting in the development of these skills.

The instant embodiment also contemplates a board game the playing of which involves significantly realistic factors such as game pieces that are representations of actual troop units and implements of war and that have defined sizes and capabilities, representations of geographical features that influence the strategic deployment and tactical movement of the game pieces, specified weather and other special conditions that prohibit or limit the use of certain of the game pieces, and assigned missions and objectives.

The preferred embodiment of the present invention also contemplates a board game the playing of which has a selectable degree of difficulty and the scoring system of which may be modified to suit the level of expertise of the players.

Also contemplated by the preferred embodiment of the present invention is a board game that is economical and easy for a manufacturer to fabricate and that is easy for a user to set up, transport and store.

BRIEF DESCRIPTION OF THE DRAWINGS

In the drawings, in which like reference characters indicate corresponding parts in all the views.

DETAILED DESCRIPTION OF PREFERRED EMBODIMENT OF THE INVENTION

Figure 1:
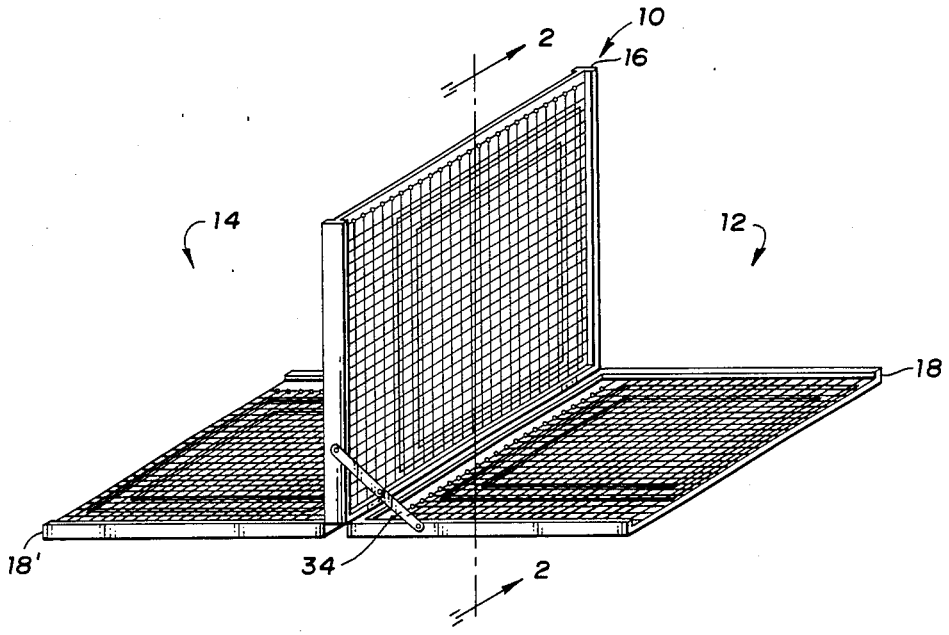
FIG. 1 is a perspective view of the preferred embodiment of the game shown as typically disposed for playing.

With reference to FIG. 1, shown is a game 10 having a first playing position 12 and a second playing position 14. The playing positions 12 and 14 are substantially alike, and described members associated with one position will, unless otherwise noted, be identified by the same, but primed, reference numbers as like members of the other position. Each playing position 12 and 14 has a vertically mounted maneuvering board 16, and a horizontally mounted situation tracking board 18, 18'. The boards may be made of wood, rigid plastic or the like; and (as shown) the vertically mounted maneuvering boards 16 may be fabricated of a single, common board. The maneuvering boards 16 are opaque and positioned to be visually isolated from the opposing playing position.

Disposed in effective apposition to each maneuvering board 16 and situation tracking board 18, 18' respectively are vertically mounted, transparent grid sheets 20, 20' and horizontally mounted, transparent grid sheets 22, 22' (shown in more detail in FIGS. 2, 3 and 4) each bearing an identical series of orthogonally disposed lines representing numbered lines of longitude 24 and latitude 26. The grid sheets 20, 20' and 22, 22' contain holes 28 therein located at intersecting line points.

A map 30 (FIGS. 2, 3 and 4), of which there are identical copies for each board, is sandwiched between each of the grid sheets 20, 20' and 22, 22' respectively and an associated maneuvering board 16 and situation tracking board 18, 18'. The maps 30 represent actual locations; and a number of sets of maps depicting areas of widely different terrains and climates, for example, rural farmland, mountain forest, tropical jungle and desert, may be provided. The grid sheets 20, 20' and 22, 22' are movable, enabling players to substitute either provided maps or privately obtained maps representing locations of historic or other special interest.

Figure 5:
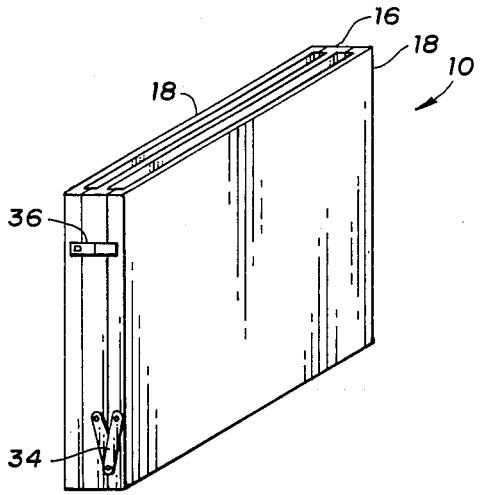
FIG. 5 is a perspective view of the game shown folded for transport or storage.
Figure 2:
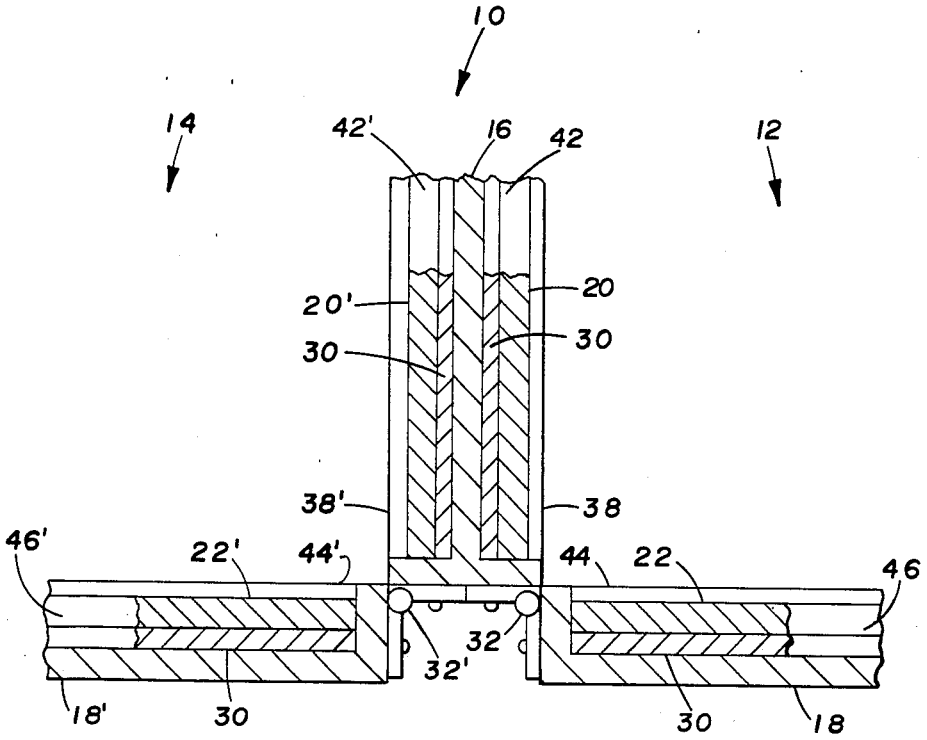
FIG. 2 is a partly broken away sectional view of the game taken along the line 2—2 of FIG. 1.
Figure 3:
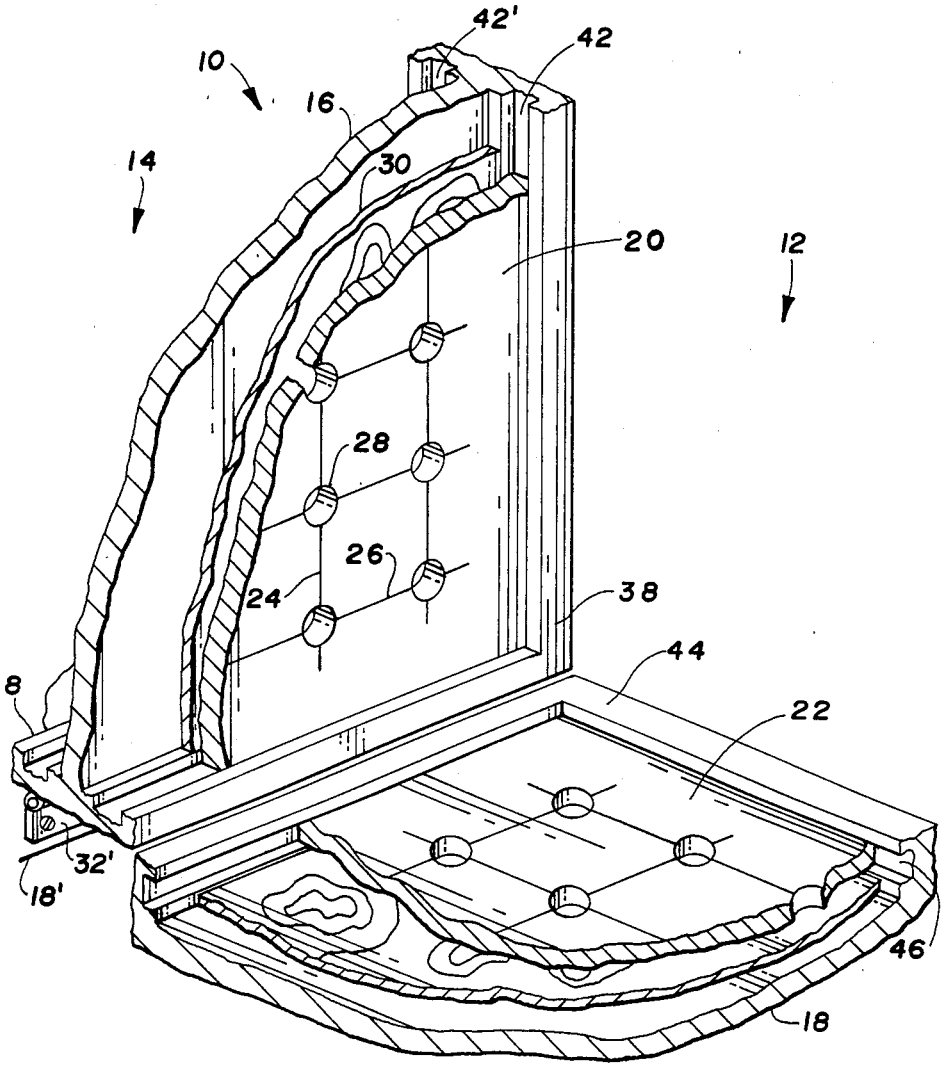
FIG. 3 is an enlarged fragmentary view, in perspective, of a corner portion of a playing surface.

As shown in FIGS. 1, 2 and 3, the situation tracking boards 18, 18' may be secured to the maneuvering board 16 by mounting hinges 32, 32, so that the game 10 may be folded as shown in FIG. 5 to facilitate its transport or storage. Limiting hinges 34 (only one of which is shown in FIGS. 1 and 5) may be attached to the maneuvering board 16 and the situation tracking board 18 at one of their associated edges and to the maneuvering board 16 and the situation tracking board 18' at their opposite associated edges. Securing latches 36 (only one of which is shown in FIG. 5) may be secured to the associated edges at opposite sides of the situation tracking boards 18, 18' to hold the game 10 in the folded position shown in FIG. 5.

Figure 4:
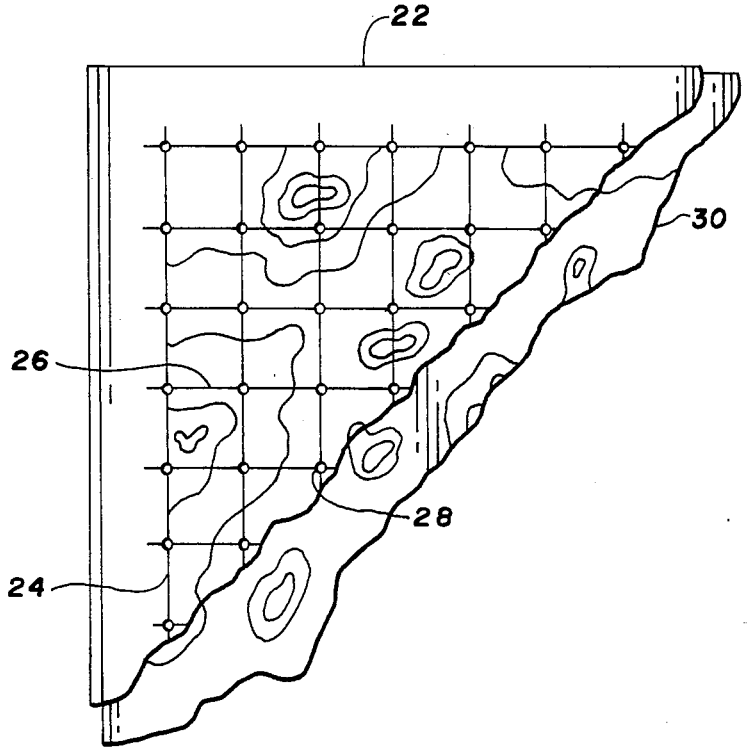
FIG. 4 is an enlarged fragmentary view of a corner portion of a playing surface.

As shown in FIGS. 2 and 4, the maneuvering boards 16 may have flanges 38, 38' at their mounted and side edges. The flanges 38, 38' may be slotted as at 42, 42, (as shown in FIG. 2) to slidably receive and secure the vertical grid sheets 20, 20' over the maps 30, which may be mounted on a stiff backing for convenience. Similarly, the situation tracking boards 18, 18' may have flanges 44, 44' at their mounted and side edges. The flanges 44, 44' may be slotted as at 46, 46, (as shown in FIG. 2) to slidably receive and secure the horizontal grid sheets 22, 22' over the maps 30.

Figure 6:
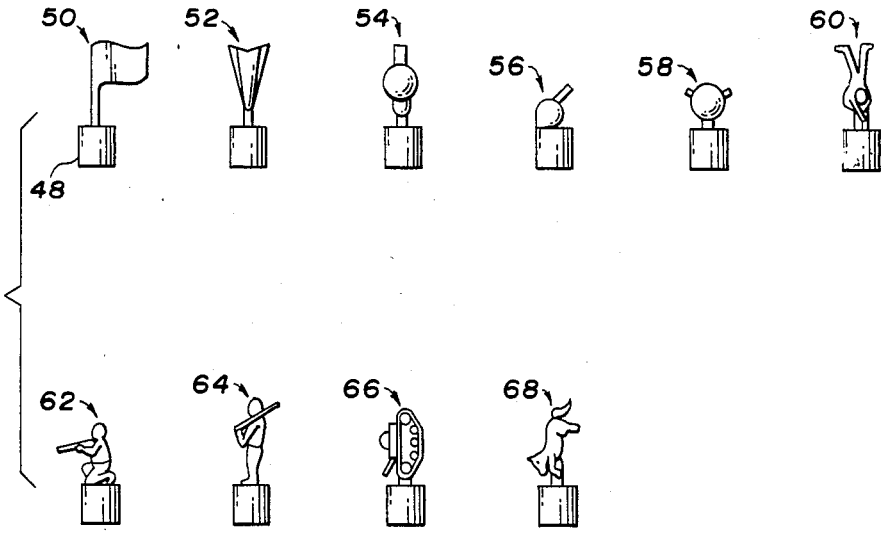
FIG. 6 is a side view of the playing pieces associated with the game.

The game 10 also includes a number of game members, or playing pieces, shown in FIG. 6. The embodiment being described uses sets of ten distinctive, plastic playing pieces; but differently designed pieces, made of any suitable material, could easily be used for simulating historic or futuristic battles, including battles at sea. The playing pieces all have bases 48 that fit into the holes 28 in the grid sheets 20, 20' and 22, 22' The pieces shown include ones having forms depicting the following: a flag 50, representing a command post or headquarters; an airplane 52, representing an airfield for air support; a helicopter 54, representing a helicopter gunship base for support; a cannon 56, representing an artillery base; a mine 58, representing a mine field; a prone soldier 60, representing an ambush; a kneeling soldier 62, representing a reconnaissance team; a standing soldier 64, representing an infantry unit; a tank 66, representing an armored unit; and a horse 68, representing a cavalry unit.

There are ten distinctive types of playing pieces, and there are ten copies of each type in a set. There are four complete sets of game pieces, two sets being of one color and two sets being of another color, the colors representing the two opposing sides. The airfield, helicopter and artillery pieces represent support units. The infantry, armored and cavalry pieces represent combat units and are numbered from one through seven, the numbers representing unit size as follows: a one represents a fire team or section having 6 men; a two represents a squad having 12 men; a three represents a platoon having 40 men; a four represents a company or troop having 180 men; a five represents a battalion or regiment having 600 men; a six represents a brigade having 1500 men; and a seven represents a division having 5000 men.

Figure 7:
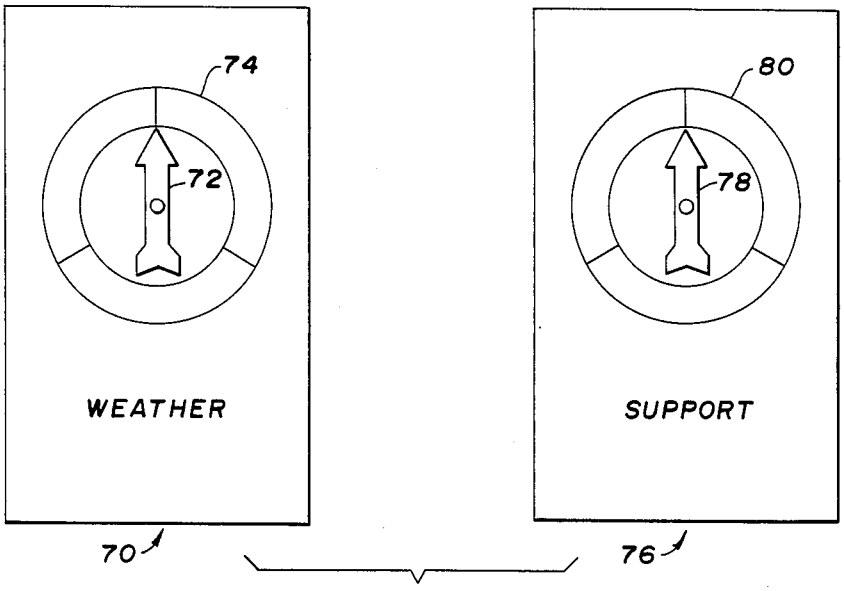
FIG. 7 is a plan view of the spinning devices associated with the game.

Shown in FIG. 7 is a spinning device 70 having a pointer 72 and a scale 74 for randomly specifying weather conditions and another spinning device 76 having a pointer 78 and a scale 80 for randomly specifying support availability. The two spinning devices 70 and 76 may easily be fabricated as one device (not shown) having a single pointer and a dual scale. The game includes dice (not shown) for randomly specifying the amount of troop movement.

The game also includes forty mission cards (not shown) for randomly specifying missions at different coordinates of longitude and latitude. It also includes twenty-five situation cards (not shown) for randomly specifying positive and negative military situations realistically associated with modern warfare and geographic location. Also included are battle cards that can be chosen by players for the purpose of indicating the type and size of a unit, the kind of support to be used, and the type of military action attack, defence or retreat) in which the unit is to engage during a battle. Each battle card is numbered to indicate its combat efficiency rating.

It must be appreciated that many methods may be used to mount, and many designs may be used to shape, the various game parts; and, while only one embodiment has been shown, it will be obvious to those of ordinary skill in the art that many modifications may be made thereto without departing from the spirit and scope of the present invention.

The procedure for playing the game may be summarized as follows. Two players or sides may play. The game 10 may be played in a north-south direction by setting it up as shown in FIG. 1, or it may be played in an east-west direction by setting it up on its side. The objective of the game is for one side to discover and capture the command post of the other side or to eliminate all of the combat units of the opposing side.

Once a decision has been made as to what terrain and climate to simulate, a corresponding set of identical maps 30 are selected and positioned between the vertical and horizontal grid sheets 20, 20' and 22, 22' respectively and the maneuvering and situation tracking boards 16 and 18, 18' respectively. The terrain and dimensions of the play area are chosen depending on the experience of the players and the time available for playing the game. Situation cards and mission cards corresponding to the selected maps are put in position and battle cards are distributed to each side. Dice and the weather and support spinning devices 70 and 76 are also put in position. The types and sizes of military units to be used are chosen, and a set of playing pieces representing its own army and a set representing the opposing army are distributed to each side. The players may then study the maps and begin to develop their individual game strategies.

Players may first locate a promising place on their respective maneuvering boards to locate their command posts. The playing piece 50 representing it may then be inserted in the hole located at the intersecting lines of longitude and latitude that correspond to the place chosen. Ambushes, mine fields, air bases, helicopter bases and all troop units are put in place in a like manner. The coordinate numbers of the command post and the other pieces are then recorded on a paper or card and placed in a secure place to ensure that these positions cannot be changed after play has begun. Players may then deploy their combat units, comprising infantry, armor and cavalry units, to locations and in strengths according to their individual game strategies.

Play may now be started by rolling the dice to determine which side will move first. Each turn includes two parts. The first roll of the dice determines how many spaces a side may move any one unit. If, and only if, a unit is moved across the lines of the opposing side must the moving side reveal to the opposing side where the unit originated and where it has been placed. The size and type of unit are not revealed.

The second part of a turn is a reconnaissance behind enemy lines. The objective of this is to locate the command post of the opposing side. To perform a reconnaissance, a side moves its reconnaissance unit to and names a set of coordinates in enemy territory; and the opponent must reveal what, if anything, is in that location. Such information provides clues to the strategy being used by the opposing side, and the side records it on the situation tracking board. If a combat unit is discovered by a reconnaissance unit, the side having deployed that unit must take a mission card. The mission need not be revealed to an opponent, but all assigned moves must be used, following the dictates of the topology of the areas traversed, until the mission has been completed. If a side decides that a unit is incapable of completing a mission by itself, another unit may be picked up to reinforce the first by moving the first unit across the location of the reinforcing unit. The reinforcement need not be revealed to the opponent. A side that can complete a mission and return the unit involved unharmed to its original location may then move that unit to an undisclosed location.

If, when the dice are tossed, a double is rolled, the side in control of the dice must take a situation card, which must be read aloud. The side may be helped or hindered by the situation described on the card.

If a combat unit encounters an ambush during a mission, the unit is eliminated. If a combat unit encounters a mine field, the unit cannot be moved for three turns. If it encounters a support unit, the support unit is eliminated. If a combat unit encounters another combat unit, a battle ensues.

When a battle is to take place, players take out battle cards that represent the sizes and types of units involved in the battle. Each player then spins the support pointer 78 to determine what kind of support will be available for the battle. One player spins the weather pointer 72 to determine weather conditions, which will have an effect on the support that may be used, during the battle. Sides then put in place the battle cards that indicate the kind of support to be used. An air strike eliminates any unit unless that unit also uses an air strike, in which case the strikes cancel each other. A helicopter gunship strike eliminates infantry and armored units unless those units also use a helicopter strike, in which case the strikes cancel each other. An artillery attack eliminates infantry. Each side then puts in place the battle cards that indicate what action they wish to take, namely, to attack, defend or retreat. Each battle card is numbered to indicate its combat efficiency rating. The numbers are summed, and the player having the highest total number wins the battle. The game continues until the command post of one side is discovered and captured by a combat unit or until one side loses all of its combat units.

What is claimed is:

1. A strategic and tactical game comprising:

a first playing position having a first vertically disposed maneuvering board and a first horizontally disposed situation tracking board;

a second playing position having a second vertically disposed maneuvering board and a second horizontally disposed situation tracking board;

a mounting structure for maintaining said first and said second vertically disposed maneuvering boards in a back-to-back relationship and said first and said second horizontally disposed tracking boards in an adjacent, coplanar relationship;

a plurality of playing pieces representative of soldiers;

a plurality of playing pieces representative of implements of war;

a plurality of maps overlaying each of said maneuvering boards and said tracking boards, each of said maps being identical;

a transparent grid sheet overlaying each of said maps, each of said grid sheets bearing an identical series of vertical and horizontal lines thereon and having holes disposed in said grid sheets at intersecting line points to receive said playing pieces;

a plurality of spinning devices for randomly specifying various playing conditions;

a plurality of cards for specifying missions, situations and battle objectives; and a plurality of dice for randomly determining the amount of advancement of said game members.

2. A game according to claim 1 wherein said first and said second vertically disposed maneuvering boards are opaque and are disposed to provide visual isolation of the playing surfaces of said first and said second maneuvering boards when viewed from said second and said first playing positions respectively.

3. A game according to claim 1 wherein said maps are representations of actual locations.

4. A game according to claim 1 wherein said maps are replaceable by removal and insertion between each grid sheet and its associated board.

5. A game according to claim 1 wherein said transparent grid sheets are movably mounted adjacent to said maneuvering boards and said tracking boards to facilitate the replacement of, secure the position of, and provide visible access to said maps.

6. A game according to claim 1 wherein said vertical and said horizontal lines of said grid sheets represent lines of longitude and latitude respectively.

7. A game according to claim 1 wherein said mounting structure comprises at least one mounting hinge for securing said first and said second horizontally disposed tracking boards to said first and said second vertically disposed maneuvering boards to facilitate folding said tracking boards against said maneuvering boards, and at least one limiting hinge for limiting and maintaining the maximum angle defined by said maneuvering boards and said first tracking board and the maximum angle defined by said maneuvering boards and said second tracking board.

8. A game according to claim 1 wherein. each of said playing pieces comprises a lower body forming a base for securing said piece in any one of the holes provided therefor in said vertical and said horizontal grid sheets and an upper body formed in the likeness of a soldier or implement of war.

9. A game according to claim 1 wherein said playing pieces representative of soldiers comprise lower bodies each forming a base for securing said piece in any one of the holes provided therefor in said vertical and said horizontal grid sheets and upper bodies formed in the likenesses of prone, kneeling and standing soldiers.

10. A game according to claim 1 wherein said playing pieces representative of implements of war comprise lower bodies each forming a base for securing said piece in any one of the holes provided therefor in said vertical and said horizontal grid sheets and upper bodies formed in the likenesses of flags, fixed wing airplanes, helicopters, cannons, mines, tanks and horses.

11. A game according to claim 1 wherein one of a plurality of said spinning devices comprises a mounting structure, an index member pivotally disposed on said mounting structure, and a scale disposed on said mounting structure in a circumferential relationship with respect to the pivot point of said index member for indicating specific weather conditions randomly selectable by said index member.

12. A game according to claim 1 wherein one of a plurality of said spinning devices comprises a mounting structure, an index member pivotally disposed on said mounting structure, and a scale disposed on said mounting structure in a circumferential relationship with respect to the pivot point of said index member for indicating specific support conditions randomly selectable by said index member.

13. A strategic and tactical game comprising:

a first horizontally disposed situation tracking board;

a second horizontally disposed situation tracking board;

a vertically disposed member having formed on a first surface thereof a first maneuvering board and having formed on a second surface thereof a second maneuvering board, a first playing position being defined by the effective combination of said first maneuvering board and said first situation tracking board and a second playing position being defined by the effective combination of said second maneuvering board and said second situation tracking board;

a mounting structure for maintaining said first and said second horizontally disposed tracking boards in an adjacent, coplanar relationship with respect to each other and in an adjacent, orthogonal relationship with respect to said vertically disposed member;

a plurality of playing pieces representative of soldiers;

a plurality of playing pieces representative of implements of war;

a plurality of maps overlaying each of said maneuvering boards and said tracking boards, each of said maps being identical;

a transparent grid sheet overlaying each of said maps, each of said grid sheets bearing an identical series of vertical and horizontal lines thereon and having holes disposed in said grid sheets at intersecting line points to receive said playing pieces;

a plurality of spinning devices for randomly specifying various playing conditions;

a plurality of cards for specifying missions, situations and battle objectives; and a plurality of dice for randomly determining the amount of advancement of said game members.

14. A game according to claim 13 wherein said vertically disposed member is and is disposed to provide visual isolation of the playing surfaces of said first and said second maneuvering boards when viewed from said second and said first playing positions respectively.

15. A game according to claim 13 wherein said maps are representations of actual rotations.

16. A game according to claim 13 wherein said maps are replaceable by removal and insertion between each grid sheet and its associated board.

17. A game according to claim 13 wherein said transparent grid sheets are movably mounted adjacent to said maneuvering boards and said tracking boards to facilitate the replacement of, secure the position of, and provide visible access to said maps.

18. A game according to claim 13 wherein said vertical and said horizontal lines of said grid sheets represent lines of longitude and latitude respectively.

19. A game according to claim 13 wherein said mounting structure comprises at least one mounting hinge for securing said first and said second horizontally disposed tracking boards to said vertically disposed member to facilitate folding said tracking boards against said maneuvering boards, and at least one limiting hinge for limiting and maintaining the maximum angle defined by said vertically disposed member and said first tracking board and the maximum angle defined by said vertically disposed member and said second tracking board.

20. A game according to claim 13 wherein each of said playing pieces comprises a lower body forming a base for securing said piece in any one of the holes provided therefor in said vertical and said horizontal grid sheets and an upper body formed in the likeness of a soldier or implement of war.

21. A game according to claim 13 wherein said playing pieces representative of soldiers comprise lower bodies each forming a base for securing said piece in any one of the holes provided therefor in said vertical and said horizontal grid sheets and upper bodies formed in the likenesses of prone, kneeling and standing soldiers.

22. A game according to claim 13 wherein said playing pieces representative of implements of war comprise lower bodies each forming a base for securing said piece in any one of the holes provided therefor in said vertical and said horizontal grid sheets and upper bodies formed in the likenesses of flags, fixed wing airplanes, helicopters, cannons, mines, tanks and horses.

23. A game according to claim 13 wherein one of a plurality of said spinning devices comprises a mounting structure, an index member pivotally disposed on said mounting structure, and a scale disposed on said mounting structure in a circumferential relationship with respect to the pivot point of said index member for indicating specific weather conditions randomly selectable by said index member.

24. A game according to claim 13 wherein one of a plurality of said spinning devices comprises a mounting structure, an index member pivotally disposed on said mounting structure, and a scale disposed on said mounting structure in a circumferential relationship with respect to the pivot point of said index member for indicating specific support conditions randomly selectable by said index member.

* * * * *